US007001216B1

(12) United States Patent
Huang

(10) Patent No.: US 7,001,216 B1
(45) Date of Patent: Feb. 21, 2006

(54) CASING FOR A MODULAR SOCKET

(76) Inventor: Huang-Chou Huang, No. 59, Sec. 1, Jiow Juang St., Nankang Dist., Taipei (TW)

( * ) Notice: Subject to any disclaimer, the term of this patent is extended or adjusted under 35 U.S.C. 154(b) by 0 days.

(21) Appl. No.: 10/972,728

(22) Filed: Oct. 25, 2004

(51) Int. Cl.
*H01R 13/648* (2006.01)

(52) U.S. Cl. ..... 439/607

(58) Field of Classification Search ..... 439/607–610
See application file for complete search history.

(56) References Cited

U.S. PATENT DOCUMENTS

| | | | | |
|---|---|---|---|---|
| 5,913,698 | A * | 6/1999 | Keng | 439/609 |
| 6,113,428 | A * | 9/2000 | Yeh | 439/609 |
| 6,368,167 | B1 * | 4/2002 | Ma et al. | 439/886 |
| 6,454,603 | B1 * | 9/2002 | Casey et al. | 439/607 |
| 6,475,033 | B1 * | 11/2002 | Zhu et al. | 439/607 |
| 6,508,670 | B1 * | 1/2003 | Hwang | 439/607 |
| 6,592,405 | B1 * | 7/2003 | Hasircoglu | 439/607 |
| 6,612,868 | B1 * | 9/2003 | Hwang | 439/607 |
| 6,659,799 | B1 * | 12/2003 | Yang | 439/607 |
| 6,682,368 | B1 * | 1/2004 | Murr et al. | 439/607 |
| 6,688,915 | B1 * | 2/2004 | Moriwake et al. | 439/607 |
| 6,733,339 | B1 * | 5/2004 | Casey | 439/607 |
| 6,762,940 | B1 * | 7/2004 | Zaremba | 361/728 |
| 6,780,053 | B1 * | 8/2004 | Yunker et al. | 439/607 |
| 6,793,526 | B1 * | 9/2004 | Hsu et al. | 439/541.5 |
| 6,835,092 | B1 * | 12/2004 | Wan et al. | 439/541.5 |
| 6,863,569 | B1 * | 3/2005 | Zhu et al. | 439/607 |

* cited by examiner

*Primary Examiner*—Gary F. Paumen
(74) *Attorney, Agent, or Firm*—Jackson Walker, LLP

(57) ABSTRACT

A modular socket casing includes a bottom face, two side walls respectively and oppositely extending from a side of the bottom face, each side wall having a bend extending from a peripheral edge of the side wall and a hook formed on a side face of the side wall and a rear plate integrally extending from a side of the bottom face and having two opposed arms each extending from a side of the rear plate and a cutout defined at a joint between the arm and the rear plate to correspond to and receive therein the hook after the rear plate is folded such that the casing is formed.

2 Claims, 5 Drawing Sheets

CASING FOR A MODULAR SOCKET

BACKGROUND OF THE INVENTION

1. Field of the Invention

The present invention relates to a casing, and more particularly to the casing for a modular socket used in a telephone line connector.

2. Description of Related Art

With reference to FIGS. 4 and 5, a conventional casing (30) of a modular socket is made of a sheet of metal and has a bottom face (31), two side walls (32) oppositely extending upright from the bottom face (31) and a rear plate (34) integrally formed with the bottom face (11) and sandwiched between the two side walls (32).

Each side wall (32) is provided with a bend (33) extending outward from a peripheral edge of the side wall (32) and a boss (37) formed on an inner face of the side wall (32). The rear plate (34) has two opposed side plates (35) each formed on a side face of the rear plate (34) and having a through hole (36) defined through a face of the side plate (35) to correspond to the boss (37).

When the casing is assembled, the rear plate (34) is folded to allow the bosses (37) to be received in the corresponding through holes (36) so as to hold the rear plate (34) in close engagement with each of the side walls (32).

Because the engagement between the side walls (32) and the rear plate (34) solely depends on the engagement between the bosses (37) and the through holes (36), during the assembly between the casing (30) and a modular socket body (40), the engagement between the bosses (37) and the through holes (36) is easily lost as a result from movement of the modular socket body (40) in the casing (30). Therefore, the user of this conventional modular socket casing often finds this drawback annoying as the casing can not fulfill the requirements.

To overcome the shortcomings, the present invention tends to provide an improved modular socket casing to mitigate the aforementioned problems.

SUMMARY OF THE INVENTION

The primary objective of the present invention is to provide an improved modular socket casing which has a rear plate able to secure engagement with two adjacent side walls to avoid possibility of detachment between the rear plate and the side walls.

Other objects, advantages and novel features of the invention will become more apparent from the following detailed description when taken in conjunction with the accompanying drawings.

DETAILED DESCRIPTION OF THE PREFERRED EMBODIMENT

Figure 1:
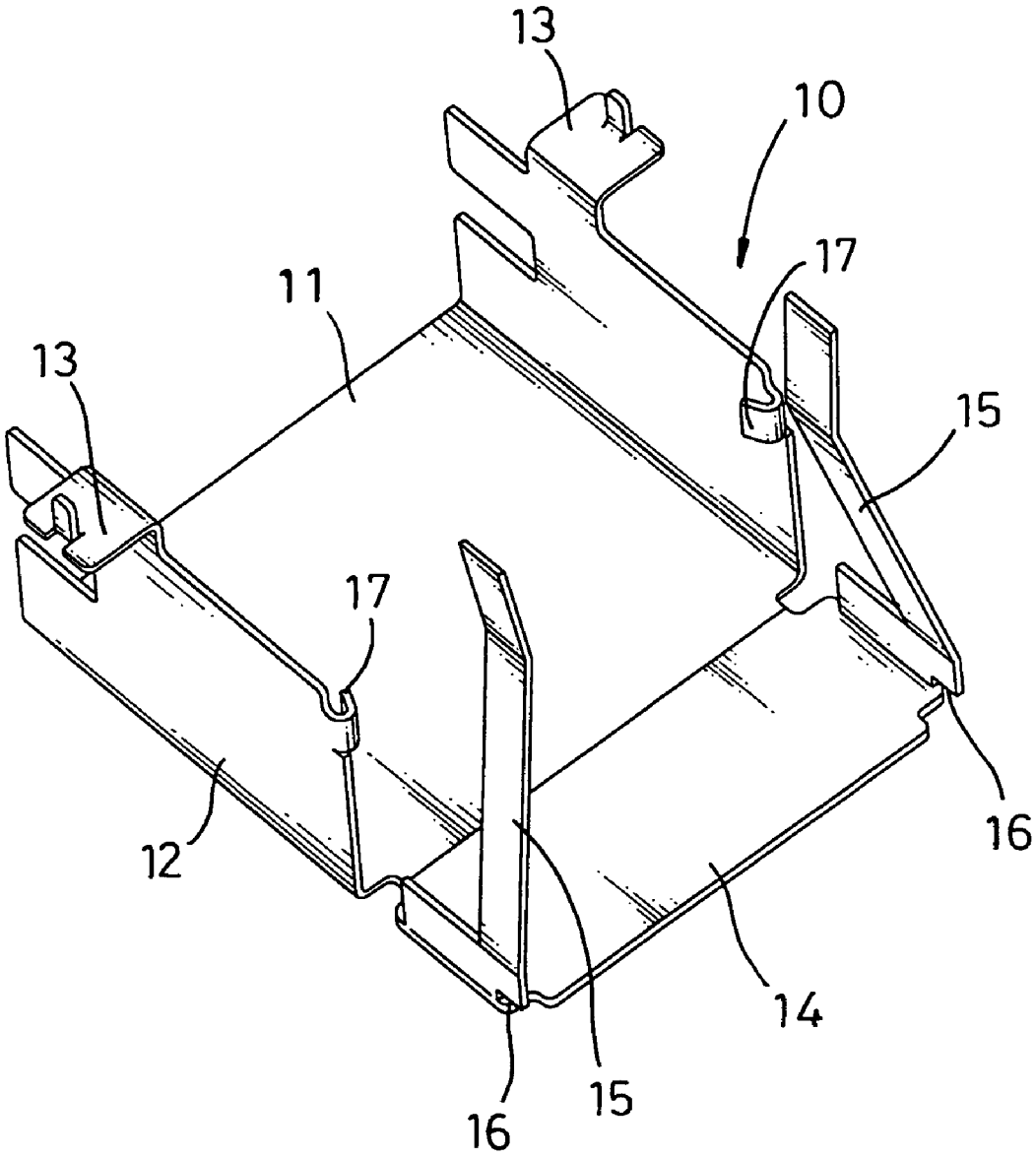
FIG. 1 is a perspective view of the casing of the present invention.
Figure 2:
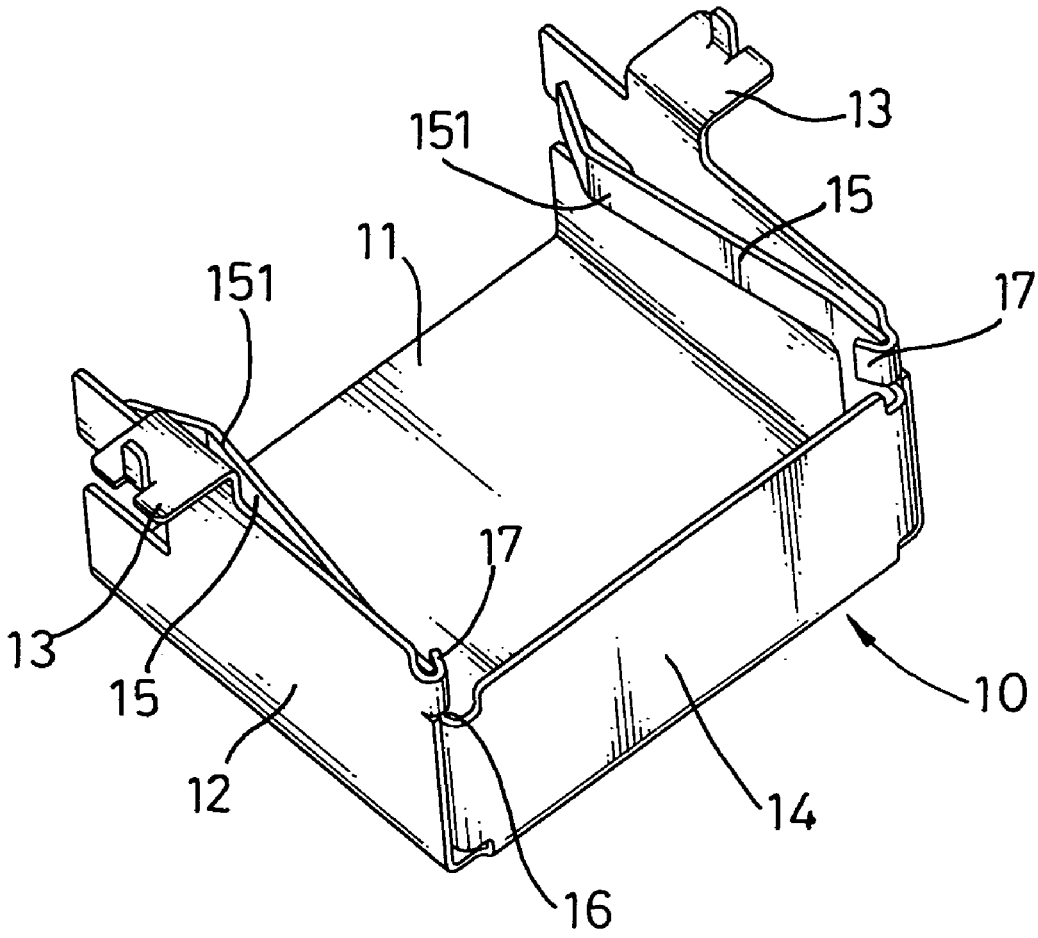
FIG. 2 is a perspective view of the casing with the rear plate securely connected to the side walls.

With reference to FIGS. 1 and 2, the modular socket casing (10) in accordance with the present invention is made of a sheet of metal and has a bottom face (11), two opposed side walls (12) each extending upright from a side face of the bottom face (11) and having a bend (13) extending out from a peripheral edge of the side wall (12) and a rear plate (14) extending from a side face of the bottom face (11) and sandwiched between the two side walls (12). The rear plate (14) has two arms (15) respectively and oppositely extending from a side face of the rear plate (14) to face each other. A cutout (16) is defined at a joint between each arm (15) and the side face of the rear plate (14). Furthermore, each side wall (12) is provided with a hook (17) formed on an inner face of the side wall (12) to correspond to the cutout (16).

Figure 3:
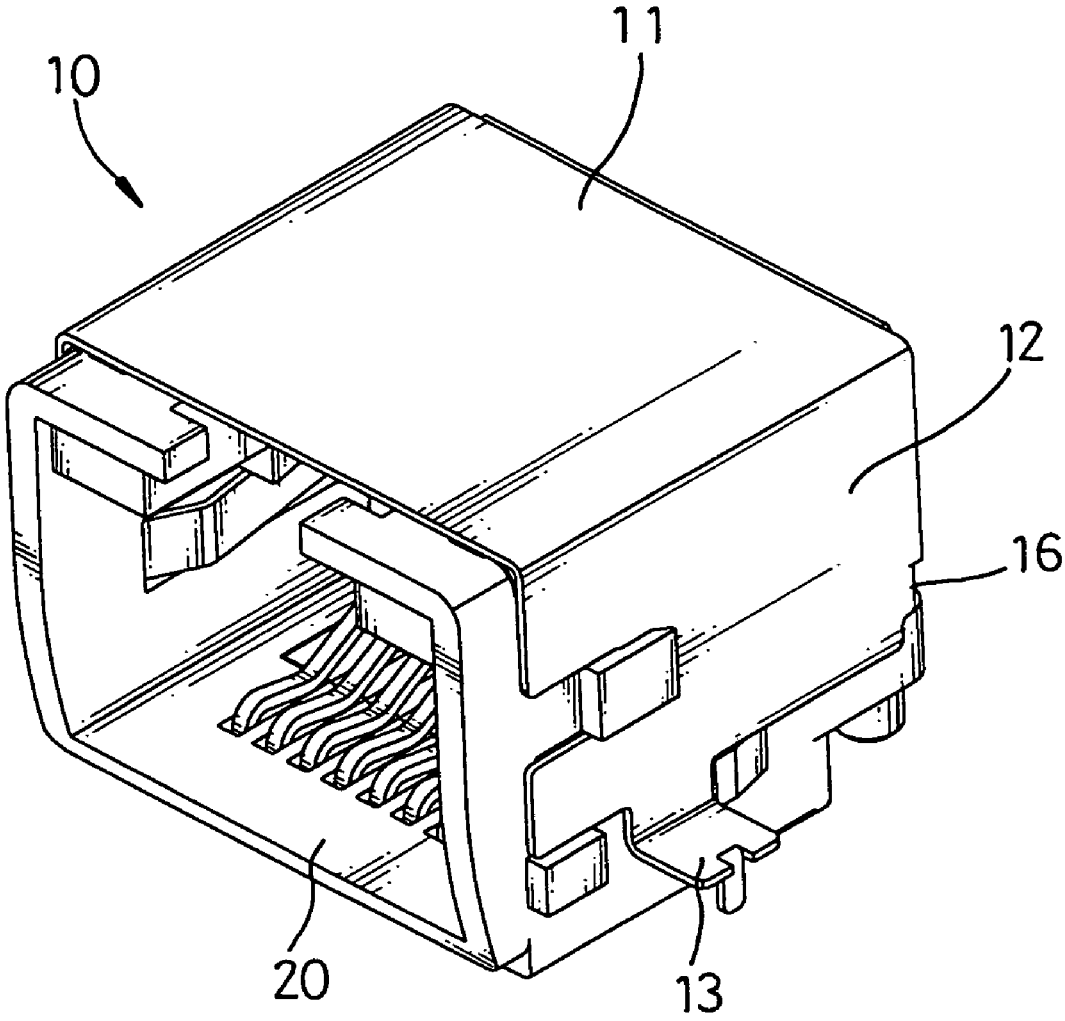
FIG. 3 is a perspective view showing that the casing of the present invention is assembled with a modular socket body.
Figure 4:
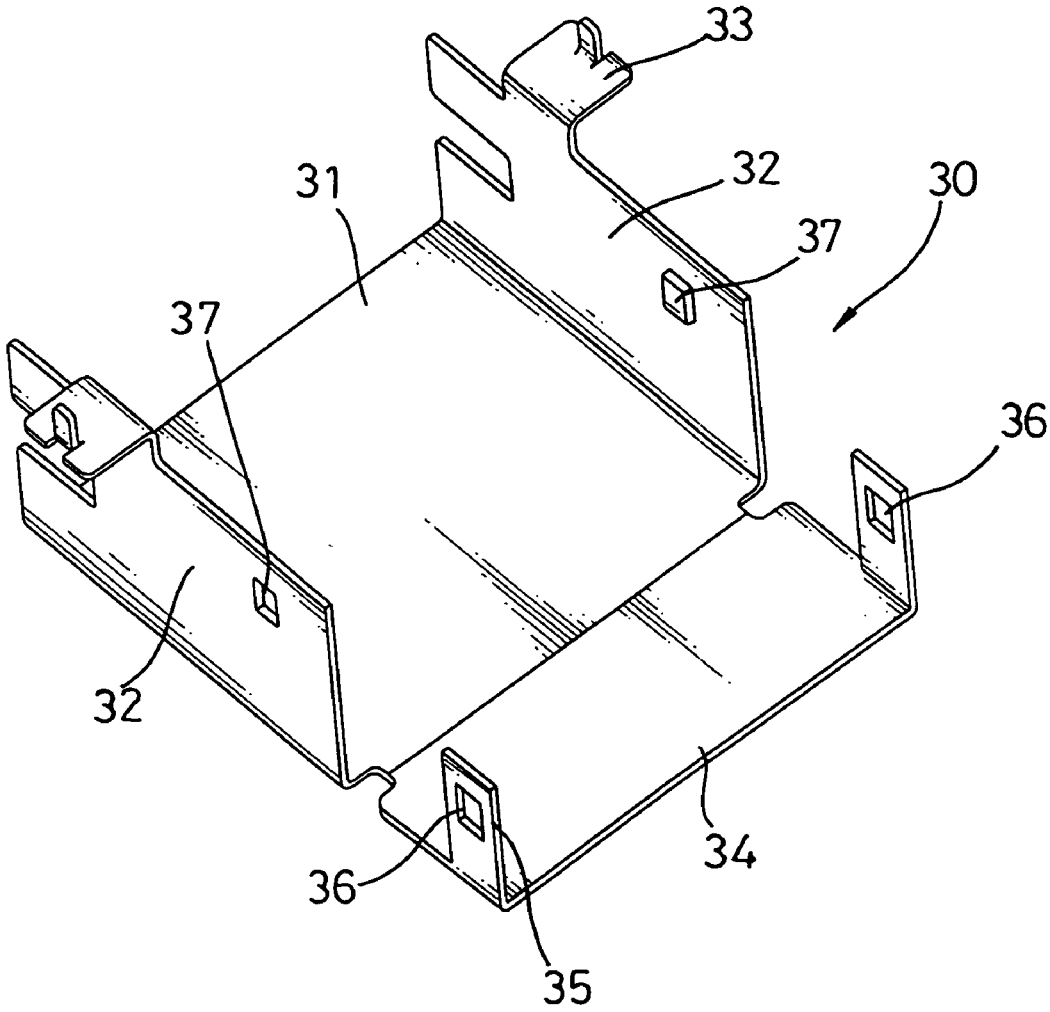
FIG. 4 PRIOR ART
FIG. 4 is a perspective view of a conventional casing.
Figure 5:
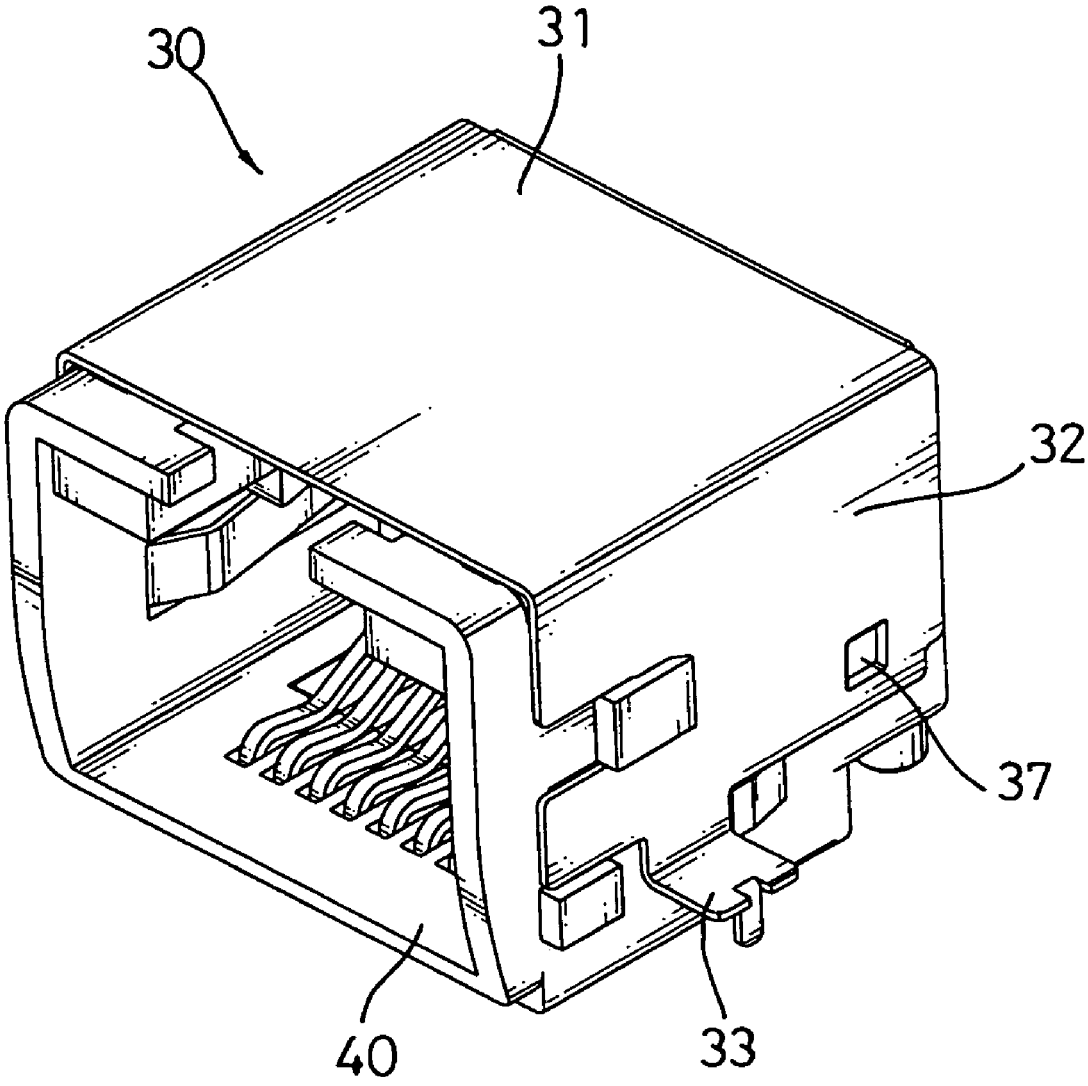
FIG.5 PRIOR ART
FIG. 5 is a perspective view of the conventional view showing that the rear plate is connected to side walls of the casing.

When the casing (10) of the present invention is assembled, the rear plate (14) is first folded to allow each hook (17) to be received in the corresponding cutout (16). After the hook (17) is securely received in the cutout (16), the rear plate (14) is securely engaged with two adjacent side walls (12). Besides, each arm (15) is provided with a twist (151) formed on a front portion thereof. As a result of having the twist (151) and the engagement between the hook (17) and the cutout (16), when a modular socket body (20) as shown in FIG. 3 is inserted into the casing (10) of the present invention, the two twists (151) clamp two opposed side walls of the modular socket body (20) to increase friction between the modular socket body (20) and the casing (10).

Therefore, the engagement between the hook (17) and the cutout (16) enhances the integrity of the casing (10) and the increase of friction between the modular socket body (20) and the casing (10) facilitates the positioning of the modular socket body (20) inside the casing (10) of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A casing for a modular socket body, the casing comprising:

a bottom face;

two side walls respectively and oppositely extending from a side of the bottom face, each side wall having a bend extending from a peripheral edge of the side wall and a hook formed on a side face of the side wall; and a rear plate integrally extending from a side of the bottom face and having two opposed arms each extending from a side of the rear plate and a cutout defined at a joint between the arm and the rear plate to correspond to and receive therein the hook after the rear plate is folded such that the casing is formed.

2. The casing as claimed in claim 1, wherein a twist is formed on a top portion of the arm for increasing friction between the modular socket body and the casing when the modular socket body is inserted between the two arms.

* * * * *